United States Patent [19]

Merrifield

[11] 4,005,508

[45] Feb. 1, 1977

[54] EASILY RELEASED BELT FASTENER

[75] Inventor: Daniel B. Merrifield, Fountain Valley, Calif.

[73] Assignee: Healthways, Los Angeles, Calif.

[22] Filed: Sept. 24, 1975

[21] Appl. No.: 616,128

[52] U.S. Cl. ..... 24/193; 24/196
[51] Int. Cl.[2] ..... A44B 11/12; A44B 11/06
[58] Field of Search ..... 24/193, 197, 196

[56] References Cited

UNITED STATES PATENTS

| | | | |
|---|---|---|---|
| 1,962,846 | 6/1934 | Pierre | 24/193 |
| 2,903,774 | 9/1959 | Harley | 24/170 |
| 3,266,110 | 8/1966 | Davis | 24/193 |
| 3,289,261 | 12/1966 | Davis | 24/193 |
| 3,608,158 | 9/1971 | Bengtsson | 24/170 |

FOREIGN PATENTS OR APPLICATIONS

| | | | |
|---|---|---|---|
| 970,611 | 9/1964 | United Kingdom | 24/197 |

*Primary Examiner*—Bernard A. Gelak
*Attorney, Agent, or Firm*—Edward D. O'Brian

[57] ABSTRACT

An easily released belt fastener can be constructed utilizing an elongated body having an opening extending through the body intermediate the ends of the body. A clamping bar is movably mounted on the body so as to extend across the opening adjacent to and parallel to a clamping surface. This clamping bar is mounted in such a manner that it is capable of being moved between a clamping position in which it is spaced from the clamping surface and a non-clamping position in which it is also parallel to the clamping surface but is located further from the clamping surface than in the clamping position. The body is formed so that an end of it may be secured in an operative position in which it can be rotated about an axis which is substantially parallel with the clamping surface. A belt may be inserted through the opening around the clamping bar and between this bar and the clamping surface then back underneath the body along itself. When tension is applied to this belt the clamping bar will be moved to the clamping position. When the body is rotated so as to space the belt from the bottom of the body the belt will be located at an angle such that the tension on the belt will move the clamping bar toward the non-clamping position, releasing the belt so that it can be pulled out of engagement with the body.

2 Claims, 5 Drawing Figures

EASILY RELEASED BELT FASTENER

REFERENCE TO KNOWN RELATED PATENTS

Carroll U.S. Pat. No. 352,029 — Hitching Device;

Ritter U.S. Pat. No. 1,515,412 — Quick Release Fastener;

Morrow, et al. U.S. Pat. No. 2,549,841 — Adjustable Quick Release Strap Splice;

Harley U.S. Pat. No. 2,862,271 — Releasable Buckles;

Hatfield U.S. Pat. No. 3,060,537 — Quickly Releasable Buckle For Safety And Harness Strap;

Roing U.S. Pat. No. 3,203,058 — Tightening Device.

BACKGROUND OF THE INVENTION

The invention set forth in this specification relates to a new and improved easily released belt fastener. Belt fasteners of the generalized category to which this invention pertains are sometimes referred to as strap clamps, releasable buckles, strap holders, hitching devices and tightening devices.

Such belt fasteners are commonly utilized to secure a strap or belt so that such a belt or strap is held under pressure and so that the tension on such a belt or strap may be released so that the belt or strap can be removed from the fastener. Fasteners of this category are and have been utilized for a wide variety of different diverse purposes. Various known fasteners of the type indicated herein have in recent years been commonly utilized in holding the straps or belts used to support various types of scuba equipment on the back of an individual.

It is not considered that known fasteners have been adequate for such usage because of various factors connected with the use of scuba equipment. A fastener for use in securing belts or straps to hold scuba equipment in place must, of course, be capable of being easily utilized by a user. Such utilization is considered to involve securing such a fastener in an operative position, the placement of a belt or strap used with such a fastener under a desired degree of tension, and the release of the fastener without difficulty. The latter is particularly important in the scuba field since on occasion it may be necessary for a user to quickly release scuba gear so as to avoid a hazard or danger.

Another factor which is quite important as far as utilization in the scuba field—and probably in any other field—is cost. A satisfactory fastener for use in the scuba field must not only be desirable from a utilitarian standpoint but it must also be desirable from an economic standpoint. This is because of the fact that even comparatively small cost advantages are considered to frequently mark the difference as to whether or not a product is commercially acceptable or not. On occasion such cost advantages cannot be achieved in a principal item of equipment such as scuba gear itself but can only be achieved in peripheral items used with such equipment such as, for example, in the fasteners utilized in holding a piece of scuba gear in place.

BRIEF SUMMARY OF THE INVENTION

A broad object of the invention is to provide new and improved easily released belt fasteners. More specifically the invention is intended to provide belt fasteners: which can be manufactured at a comparatively nominal cost; which are capable of being easily and conveniently secured in operative positions; which permit belt tension to be adjusted without significant difficulty; and which are capable of being easily and conveniently actuated so as to release a belt. The latter is considered to be quite important in connection with the presently preferred or intended use of the fasteners of the invention in the scuba field. It is to be understood, however, that these fasteners may be employed in other applications.

In accordance with this invention these objectives are achieved by providing a belt fastener which includes: an elongated body having first and second ends, sides, a top and a bottom and an opening located therein which extends between the top and the bottom and which is spaced from the sides and the ends, a clamping surface means for use in engaging the strap so as to frictionally hold a strap located on the body so as to extend generally between the sides along the portion of the opening closest adjacent to the first end, bearing surface means for movably mounting a clamping bar located on the body adjacent to the opening, a clamping bar having ends, these ends being supported within the bearing means so that the bar is capable of being moved between a non-clamping position parallel to and spaced from the clamping surface means and a clamping position in which the clamping bar is parallel to and closer to the clamping surface means than in the non-clamping position, and an attachment means located on the second end of the body for securing the body in an operative position in which it can be rotated generally about an axis which is substantially parallel with the clamping surface means.

With this structure the opening, the clamping bar and the clamping surface means are all shaped so that when the clamping bar is in the non-clamping position a belt may be located so as to extend underneath the first end of the body, beneath the bottom, through the opening to the top of the body, around the clamping bar, between the clamping bar and the clamping surface means then along itself adjacent to the body. The clamping bar is responsive to tension applied to a belt which is so located so that in response to such tension the clamping bar will be moved from its non-clamping position to its clamping position. In such clamping position the clamping bar engages a belt which is so located so as to frictionally hold the belt against movement relative to the body. When a belt is secured in such a position the first end of the body is capable of being moved relative to the body so as to vary the angular relationship between the clamping bar and the body so that the tension on the belt will move the clamping bar to its non-clamping position. Such movement will release the belt to a sufficient extent so that it can be pulled out of engagement with the body.

BRIEF DESCRIPTION OF THE DRAWING

The invention is best more fully explained with reference to the accompanying drawing in which.

Figure 1:
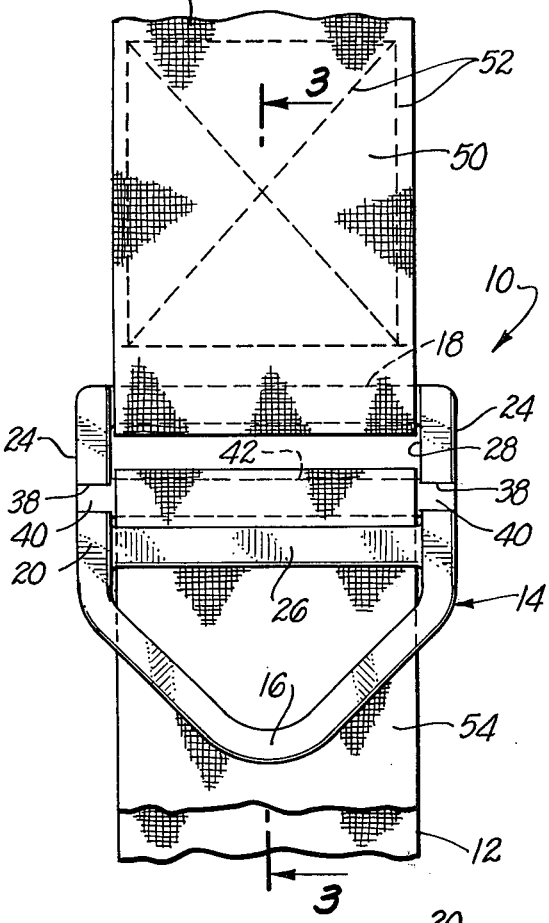
FIG. 1 is a top plan view of a presently preferred embodiment or form of a fastener of the present invention in an operative position in which a belt is secured under tension on this fastener.
Figure 2:
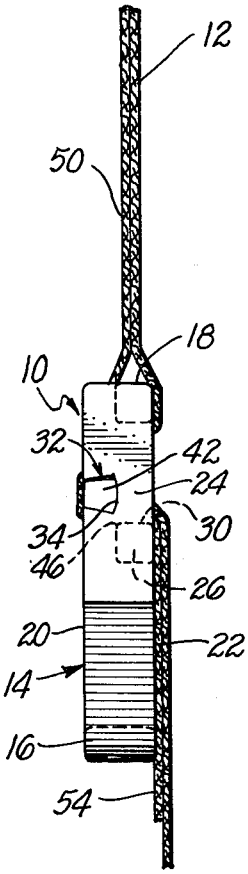
FIG. 2 is a side elevational view of the belt and fastener shown in FIG. 1.
Figure 3:
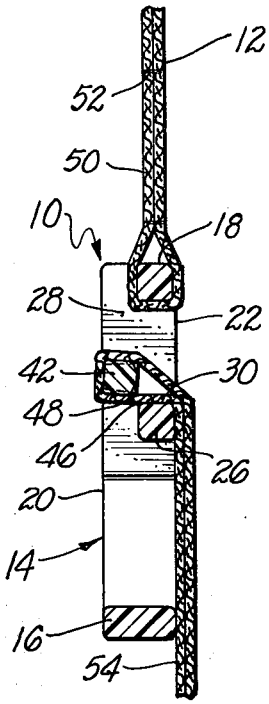
FIG. 3 is a partial cross-sectional view taken at line 3—3 of FIG. 1.
Figure 5:
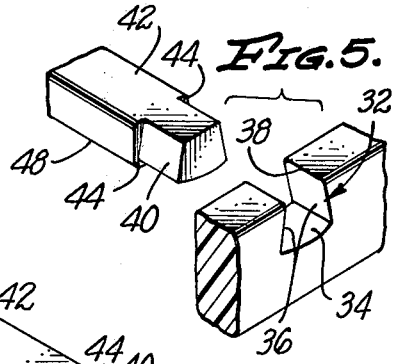
FIG. 5 is an isometric exploded view of portions of parts of the fasteners shown in the preceding figures.
Figure 4:
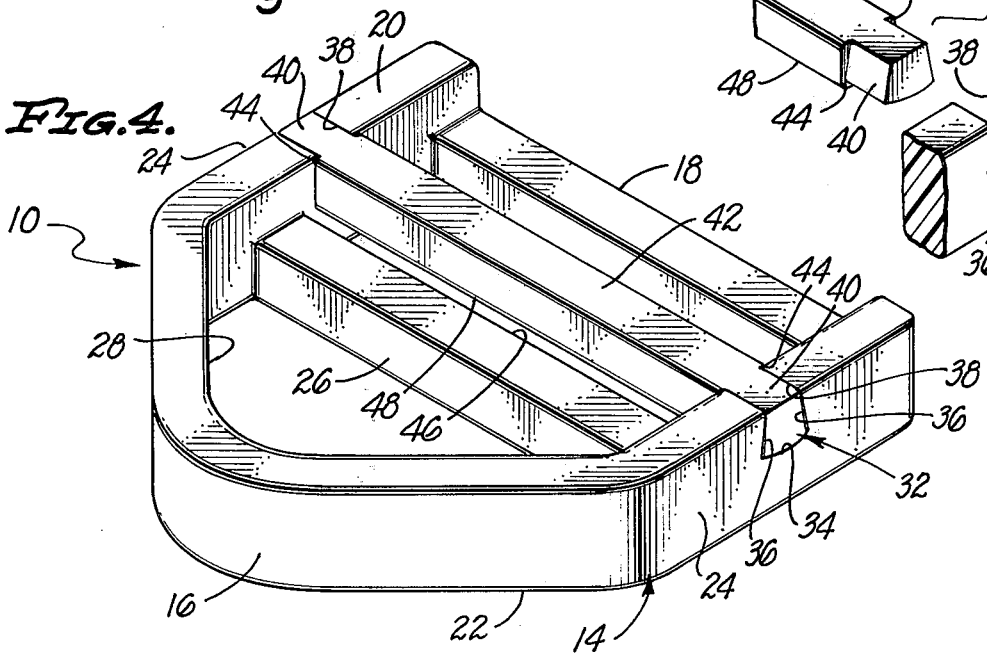
FIG. 4 is an isometric view of the fastener shown in the preceding figures.

The precise construction illustrated in the drawing embodies certain essentially intangible features and/or principles of the invention as are set forth in the appended claims. Through the use or exercise of routine engineering skill in the fastener industry these principles or features can be easily adapted so as to be utilized in a variety of somewhat differently appearing and differently constructed fasteners.

DETAILED DESCRIPTION

In the drawing there is shown a belt fastener 10 constructed in accordance with this invention so as to be utilized in securing a belt 12 so that this belt 12 is held under tension. The belt 12 may be constructed in any convenient known manner. It is considered that normally the belt 12 will be an elongated fabric belt formed out of a polymer material, such as a polyolefin. As far as the operation of the fastener is concerned the construction of the belt 12 is substantially immaterial. It is, however, considered significant that the fastener 10 operates satisfactorily even when the belt 12 is manufactured out of a comparatively "slick" material such as polypropylene, polyethylene and the like manufactured into a webbing type structure by various known techniques.

The fastener 10 includes an elongated body 14 having a first end 16, a second end 18, a top 20, a bottom 22, and spaced parallel sides 24. This entire body 14 is preferably integrally formed out of a comparatively strong, inert, rigid material such as common ABS polymer material so as to include a rod 26 extending between the sides 24 so as to define an internal opening 28 located between the ends 16 and 18 and the sides 24 and extending between the top 20 and the bottom 22. The rod 26 is formed so as to include a surface 30 generally facing the second end 18. This surface 30 may be referred to as a clamping surface or a clamping surface means because of its function as hereinafter described.

Aligned bearing openings or means 32 are also formed in the sides 24 adjacent to and spaced from the rod 26. These bearing openings 32 have arcuate bottoms 34 spaced from the top 20 and walls 36 which converge toward one another as they extend from the bottoms 34. These walls 36 intersect the top 20 along the sides 24 so as to define entrances 38 to the openings 32 which are of smaller dimension than these openings 32. These bearing openings 32 are constructed in this manner so that ends 40 of a clamping bar 42 may be snapped into the bearing openings 32 in such a manner that the bar 42 is movably held upon the body 14.

These ends 40 generally conform in shape to the shapes of the bearing openings 32 but are slightly smaller in dimension than the bearing openings 32 so as to permit the bar 42 to be moved or "rocked" relative to the clamping surface 30 between a clamping position in which this bar 42 is parallel to and spaced from the surface 30 and a parallel non-clamping position in which the bar 42 is located further from the surface 30 than in the clamping position. Shoulders 44 on the bar 42 adjacent to the ends 40 prevent the bar 42 from being moved linearly relative to the body 14. The comparatively restricted dimensions of the entrances 38 of course serve to secure the bar 42 on the body 14.

It is to be noted that with the preferred embodiment of the invention the bar 42 is located so as to extend from the top 20 beneath this top 20 while the rod 26 is located adjacent to the bottom 22 so as to extend upwardly from this bottom 22. With this construction edges 46 and 48 on the rod 26 and on the bar 42, respectively, are located closely adjacent to one another approximately midway between the top 20 and the bottom 22 so that the spacing of these edges 46 and 48 will be varied as the fastener 10 is used and as the bar 42 is moved between the two positions indicated in the preceding.

In one manner of use an end 50 of the belt 12 will be formed into a loop by this end 50 being passed through the opening 28 adjacent to the end 18 and then secured to the length of the belt 12 by appropriate stitching 52. This manner of attachment is used so that the fastener 10 may be rotated about an axis which is substantially parallel to the clamping surface 30 when the fastener 10 is used. Other equivalent means of mounting the fastener 10 can, of course, by employed. There is no necessity that the end 18 even be secured to a belt used with the fastener 10.

The particular belt 12 also includes another end 54 which is passed beneath the bottom 22, around the bar 42, then generally between the edges 46 and 48 along the surface 30 and back generally across or around the rod 26 so as to extend beneath the body 14 along the first end 16. With this structure the end 54 is in effect held in contact with the bottom 22 of the body 14 by the belt 12 itself. It will be realized that this end 54 can only be installed in an operative position as described when the bar 42 is in a non-clamping position in which it is generally spaced from the surface 30 to as great an extent as reasonably possible.

Once the end 54 has been located in an operative position as described the belt 12 may be placed under tension by either pulling on the end 54 and/or by pulling on the belt 12 itself adjacent to the end 54. As tension is applied such tension will cause very limited movement of the bar 42 toward the surface 30 so as to place the edges 46 and 48 in close proximity to one another. As such movement is accomplished the bar 42 will be moved to what is referred to in the preceding as its clamping position. In such position there is adequate friction between the belt 12 and the body 14 and between the belt 12 and the bar 42 so as to secure the belt 12 so that it is held under tension.

By lifting the first end 16 so as to pivot the body 14 relative to the end 50 the angle at which the belt 12 extends in the vicinity of the bar 42 will be changed to a sufficient extent so that the tension on the belt 12 will tend to move the bar 42 to what is referred to in the preceding as a non-clamping position. In this position of the belt 12 the friction on the belt 12 is released to a sufficient extent so that the end 54 may be conveniently pulled from the body 14 so as to free the belt 12 from the fastener 10 through the use of minimal force.

It is believed that it will be obvious from the preceding that the fastener 10 is a comparatively simple, effective device capable of being easily and conveniently manufactured at a comparatively nominal cost. This particular fastener 10 is formed so that the first end 16 is of a substantially "V" like configuration which is considered to facilitate manual engagement and movement of this end 16. Obviously the first end 16 may conveniently be manufactured so as to have a somewhat different appearance. The body 14 is constructed so that the second end 18 serves as a means for attaching the body 14 so that it is in an operative position.

Separate conventional means (not shown) can, if desired, be employed for this purpose although this is not considered desirable because of cost considerations.

The particular fastener 10 is considered to be especially desirable because it utilizes a minimum of material and because the two separate parts of this fastener 10—the body 14 and the bar 42—may be easily and conveniently manufactured and assembled together. When they are so assembled they are used in such a manner that the angular and frictional relationships can be utilized to secure a belt such as the belt 12 firmly in place in such a manner that the belt 12 may be easily and quickly released. The latter is considered quite important in the scuba field.

I claim:

1. An easily released belt fastener which comprises:

an elongated body having first and second ends, sides, a top and a bottom, said body also having an opening located therein which extends between said top and said bottom and which is spaced from said sides and said ends, clamping surface means for use in engaging a strap so as to frictionally hold such a strap, said clamping surface means being located on said body so as to extend generally between said sides along the portion of said opening closest adjacent to said first end, bearing means for movably mounting a clamping bar located on said body adjacent to said opening and to said clamping surface means, said bearing means comprising bearing openings extending through the top of each side and having an enlarged shaped opening portion in each side, a clamping bar having ends, said ends being shaped for limited rocking movement in said shaped opening portions and being supported within said bearing means so that said bar is capable of being moved between a non-clamping position parallel to and spaced from said clamping surface means and a clamping position in which said clamping bar is parallel to and closer to said clamping surface means than in said non-clamping position, and, said clamping bar and said clamping surface means being located adjacent to said top and to said bottom, respectively, so as to have adjacent edges which are capable of being moved relative to one another as said clamping bar is moved between said clamping and said non-clamping positions, attachment means located on said second end of said body for use in securing said body in an operative position in which said body can be rotated generally about an axis which is substantially parallel with said clamping surface means, said opening, said clamping bar and said clamping surface means being shaped so that when said clamping bar is in said non-clamping position a belt may be located so as to extend underneath said first end of said body, beneath said bottom, through said opening to said top, around said clamping bar, between said clamping bar and said clamping surface means and then along itself adjacent to said bottom, said clamping bar being movable in response to tension applied to a belt which is so located so that as tension is applied to such a belt said clamping bar is moved from said non-clamping position to said clamping position, said clamping bar engaging a belt which is so located in said clamping position so as to hold said belt against movement relative to said body, when said body is secured in an operative position by said attachment means said first end of said body being capable of being moved so as to vary the angular relationship between said clamping bar and said body to a sufficient extent so that the tension on the belt will move said clamping bar to said non-clamping position, releasing such a belt so that it can be pulled out of engagement with said body.

2. A fastener as claimed in claim 1 wherein:

said shaped opening portions are each shaped so as to include arcuate bottoms and converging walls which lead to the top of said body so as to define restricted entrances into said openings, said ends of said clamping bar are shaped to correspond to the shape of said bearing openings and are smaller than said bearing openings so as to permit movement of said clamping bar between said clamping and said nonclamping positions, said ends and said bearing openings being so shaped so that said clamping bar can rock back and forth when it is moved between said positions.

* * * * *